United States Patent [19]

Beaullieu

[11] Patent Number: 4,945,706

[45] Date of Patent: Aug. 7, 1990

[54] LIGHTWEIGHT OVERHEAD BEAM FOR PORTABLE DISPLAY STRUCTURE

[75] Inventor: Bryan Beaullieu, Burnsville, Minn.

[73] Assignee: Skyline Displays, Inc., Burnsville, Minn.

[21] Appl. No.: 309,417

[22] Filed: Feb. 10, 1989

[51] Int. Cl.[5] ..... E04C 2/30

[52] U.S. Cl. ..... 52/731; 160/368.1; 211/105.1; 248/205.2

[58] Field of Search ..... 52/730–732, 52/646, 222, 105, DIG. 4, DIG. 1; 211/105.1, 123; 248/205.2, 206.5; 160/368.1, 38, 352

[56] References Cited

U.S. PATENT DOCUMENTS

| | | | |
|---|---|---|---|
| 1,175,077 | 3/1916 | Peirce | 52/697 |
| 3,309,129 | 3/1967 | Newman et al. | 52/DIG. 4 |
| 3,897,288 | 7/1975 | Fayling | 52/DIG. 4 |
| 4,258,515 | 3/1981 | Owen | 52/105 |
| 4,377,314 | 3/1983 | Gevers | 52/222 |
| 4,471,548 | 9/1984 | Goudie | 52/DIG. 4 |
| 4,610,119 | 9/1986 | Bench | 52/455 |
| 4,658,560 | 4/1987 | Beaulieu | 52/646 |

OTHER PUBLICATIONS

Plastics Engineering Handbook, Edited by Joel Frados, Van Nostrand Reinhold Co., New York, 1976, pp. 58, 64, Sci. Lib. Call No. TP 1130 S58.

*Primary Examiner*—James L. Ridgill, Jr.
*Attorney, Agent, or Firm*—Paul L. Sjoquist

[57] ABSTRACT

A lightweight portable beam for attachment to a portable display structure by a simple hanging bracket, the beam formed of two pieces of elongated flexible material, typically plastic, wherein one piece of material has a width dimension larger than the second piece of material, both pieces of material having an attachment device extending along their respective elongate edges, to cause the wider material piece to become bowed outwardly when attached to the narrower piece.

16 Claims, 1 Drawing Sheet

LIGHTWEIGHT OVERHEAD BEAM FOR PORTABLE DISPLAY STRUCTURE

BACKGROUND OF THE INVENTION

The present invention relates generally to exhibit display systems, and more particularly to the field of portable display exhibits, of the type having a lightweight framework adapted for easy erection and disassembly.

The field of portable exhibit display structures has expanded rapidly in recent years, to meet the need for providing truly portable structures of lightweight material, which may be readily transported from place to place and quickly erected for display purposes. One such structure is disclosed in my U.S. Pat. No. 4,658,560, issued Apr. 21, 1987, wherein a portable frame consisting of lightweight triangulated struts is combined with a number of vertical channel members to form a structure for hanging sheets of plastic material to serve as a display surface. Although the frame structure itself is extremely lightweight and incapable of supporting significant vertical loading, the channel members do provide some vertical rigidity for supporting limited loading. After plastic panels are hung on this structure to form a display, it has the appearance of a curved wall and is suggestive of a solid wall construction, even though it actually has only limited supportive strength. The display structure may be used to support lights, shelving, and various types of hanging brackets, if the vertical loading is kept within predefined limits.

Another such portable display structure is disclosed in my international patent application No. PCT/US87/02157, filed Aug. 26, 1987, which discloses a display frame comprised of interlocking members, and which may be readily assembled and disassembled. This display structure is adapted for hanging plastic panels over the frame members, and may be further adapted for the attachment of lights, shelving and other structural members.

Since portable display structures function primarily to provide a pleasing visual perception, considerable effort is made to select display panel materials which will enhance this visual perception. The lighting and other materials associated with the display are also selected to enhance this perception, while at the same time all materials must be readily adaptable to ease of assembly and disassembly. For this reason the display panels are typically selected from plastic sheet material, frequently having a fabric covering, which may be readily rolled up for deposit in a storage container. The frame and channels are also adaptable for assembly and disassembly, and for storage in a portable container, so that the entire assembly may be easily transported from one location to another. It is therefore a desirable feature of structures of this type to have the appearance of rigidity and strength when in the erected form, while at the same time being adaptable for quick assembly and/or disassembly, and for easy storage into containers which may be transportable.

The present invention provides an improvement to display structures of the foregoing types, by further enhancing the perception of strength and beauty while in the erected condition, but being formed by lightweight flexible materials which may be readily assembled and disassembled.

SUMMARY OF THE INVENTION

The present invention is adapted as an attachment to a portable display structure, adapted for two-point attachment to the display frame. The invention is formed of flexible material which may be readily adapted for storage, and which may be quickly attached to the frame. A first elongate sheet of flexible material has hanging brackets affixed to respective ends, and a second elongate sheet of flexible material, wider than the first sheet, is adapted for edgewise attachment to the first sheet. When the respective edges of the two sheets are attached together the wider sheet forms a natural outward bow away from the first sheet, thereby creating an elongate beam having three-dimensional stability. Because the beam is entirely formed of lightweight material it may readily be hung on a portable display structure without creating excessive vertical loading forces.

It is the principal object of the present invention to provide a lightweight beam construction having the appearance of strength and rigidity, from plastic sheet materials.

It is another object of the present invention to provide a lightweight beam construction from plastic sheet materials, which may be readily attached to a portable display structure.

It is another object of the present invention to provide a lightweight beam construction from plastic sheet materials, having three-dimensional stability when attached to a portable display frame.

It is a further object of the present invention to provide a lightweight beam construction for attachment to a portable display structure, wherein translucent plastic sheet materials are used to permit back lighting for graphic information printed on the panels.

DESCRIPTION OF THE DRAWINGS

The foregoing and other objects and advantages will become apparent from the following specification and claims, and with reference to the appended drawings, in which:

DESCRIPTION OF THE PREFERRED EMBODIMENT

Figure 1:
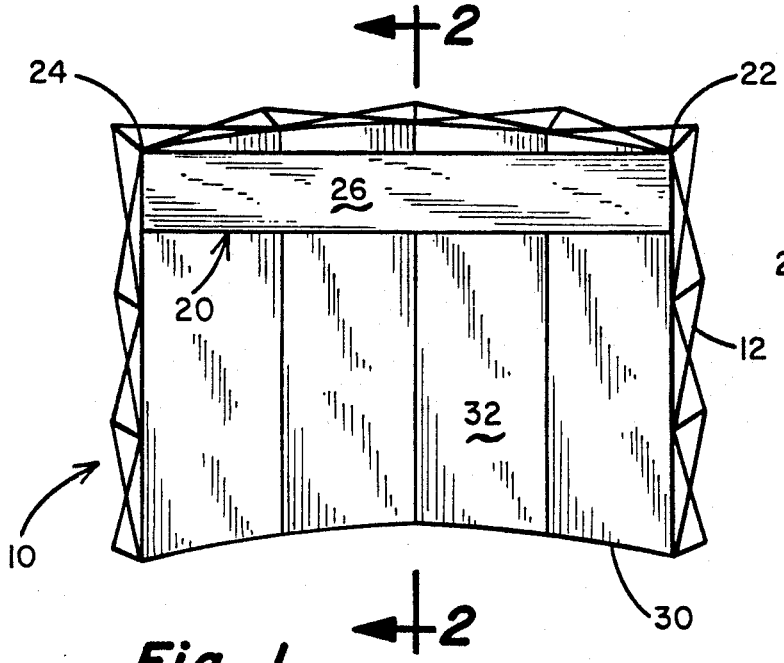
FIG. 1 shows an isometric view of the invention attached display structure.

Referring to the drawings, a portable display structure is generally shown at 10, having a lightweight overhead beam 20 attached thereto. Portable display structure 10 includes a network of triangulated rods 12 arranged to form a collapsible structure which may be easily assembled and disassembled. The framework 12 does not form a part of the present invention, except as an example of the type of framework which may be typically found in the industry to form portable exhibit display frames. Such frames are characterized by the common feature that they incorporate a reasonably complex network of struts or rods which are mutually pivotally interconnected, and which typically collapse into a relatively small, compact bundle for storage and transportation.

Other types of portable display structures are equally useful in connection with the present invention. For example, certain portable display structures are constructed from rods or channels which are assembleable into a generally rectangular grid, one example of which is disclosed in my co-pending international patent application referred to above. Display structures of this type typically have a curvilinear front display face, or a flat front display face which may be recessed within forwardly projecting end sections. The present invention can be readily adapted for use with this type of display structure since it utilizes only a two-point mounting system, wherein brackets are affixed to the respective ends of the invention and are adapted for attachment to the particular framework of the display structure.

Because of the inherent construction of framework 12, the exhibit display structure 10 is typically designed to form an arcuate wall edge 30. A wall surface 32 is typically formed by hanging a number of plastic sheets along the inner curve of framework 12, to create what is perceived as a solid wall surface 32.

The present invention comprises a lightweight overhead beam 20 for hanging between two points along framework 12, to form a bridging assembly across the front overhead surface of portable display structure 10.

Figure 2:
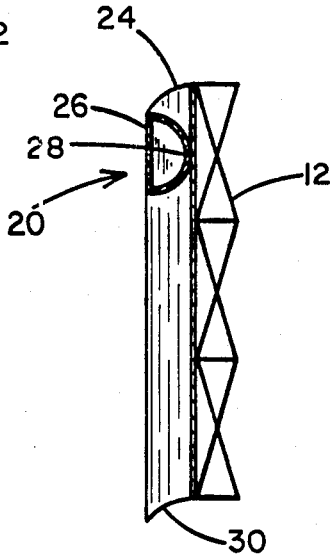
FIG. 2 shows a cross-sectional view taken along the lines 2—2 of FIG. 1.

FIG. 2 shows a cross-sectional view taken along the lines 2—2 of FIG. 1. The overhead beam structure 20 is formed of two pieces of plastic sheet material; a front sheet 26 forms a front surface of beam structure 20, and a rear sheet 28 forms a rear surface of beam structure 20. The ends of beam structure 20 are supported by a connection along edge 24, and by a second connection along edge 22, both of which connections are made to frame 12.

Figure 3:
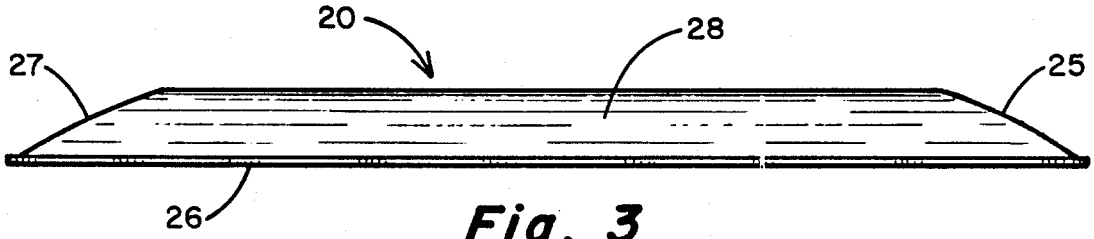
FIG. 3 shows a top view of the invention.

FIG. 3 shows a top view of beam structure 20, further illustrating the curved rear surface 28 which is attached along its respective edges to a flat front surface 26. The curved rear surface 28 has generally elliptical-shaped cutouts 25 and 27 at either end, in order to conform and fit within the arcuate curve 30 of panel surface 32. If the beam structure 20 is adapted for attachment to a frame having a flat surface rather than a curvilinear surface, the rear surface 28 may then be cut along a perpendicular line such as 33, for the arcuate cutout is not needed.

Figure 4:
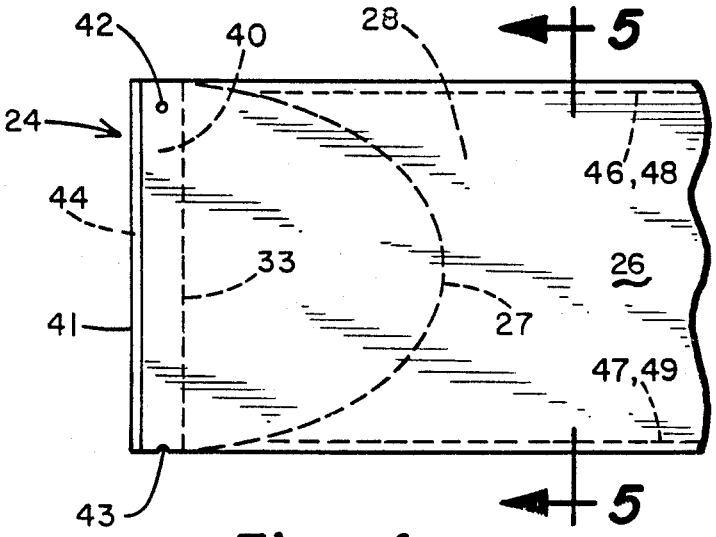
FIG. 4 shows an expanded view of an end section of the invention.
Figure 5:
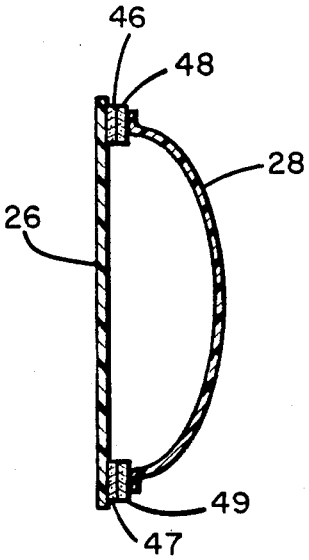
FIG. 5 shows a cross-sectional view taken along the lines 5—5 of FIG. 4.

FIG. 4 shows an enlarged section of beam structure 20, including the edge 24. FIG. 5 shows a cross-sectional view taken along the lines 5—5 of FIG. 4. A plate 40 is preferably affixed to the rear surface of sheet 26, as by gluing, to form edge 24. A strip of flexible magnetic material 44 may be affixed along the rear surface of plate 40, and plate 40 may have an attachment pin 42 and/or a notch 43, all for purposes of attaching the apparatus to the framework 12. One or more attachment mechanisms may be utilized, depending upon expediency and the nature of construction of the portable display frame 10. For example, in the portable display frame structure described in my U.S. Pat. No. 4,658,560, a vertical channel member is downwardly extending in alignment with edge 24, and the vertical channel member includes an elongate strip of magnetic material affixed along its front surface. In this case, magnetic strip 44 may be utilized to engage plate 40 against the magnetic strip of the vertical channel, to provide an inward holding force against the vertical channel. Additionally, the vertical channel member includes a plurality of slots, and plates 40 may be constructed to have one or more projecting tabs which may be adapted for engagement into the slots of the vertical channel member, in a manner very similar to a conventional shelf-hanging bracket, engaging slots in a vertical bracket attached to a wall.

Alternatively, a framework may have, or may be provided with, a hole or recess which may be mated in alignment with projecting pin 42, for purposes of hanging plate 40 against the framework. As a further alternative, the framework may itself have a projecting pin which may be aligned into notch 43 for purposes of supporting the plate 40. Combinations of the foregoing attachment mechanisms may be used, in any particular arrangement, or other and further attachment mechanisms may be readily devised for the purpose of holding and supporting the beam structure end points to the frame assembly.

The respective top and bottom edges of sheet 26 include a gripping material such as an elongated magnetic flexible strip 46 and 47. Similarly, the respective top and bottom edges of sheet 28 include an elongated flexible magnetic strip 48 and 49. The respective magnetic strips 46 and 48 are aligned in edgewise alignment to cause the top edges of sheets 26 and 28 to become adhered together, and the respective magnetic strips 47 and 49 are similarly aligned, to cause the bottom edges of sheets 26 and 28 to become adhered together. Since sheet 28 is inherently and necessarily of wider dimension than sheet 26, the foregoing edgewise attachment will create an outward bow in sheet 28. This outward bow forms a geometric cross section as shown in FIG. 5, and provides dimensional stability to hold the composite structure formed by the attached sheets in a relatively rigid shape. In an alternative form of edgewise attachment of sheets 26 and 28, hook-and-loop fasteners commonly known as "Velcro" fasteners, may be used in substitution of the respective magnetic strips. As a further alternative in structure to form the edgewise attachment between sheets 26 and 28, it is also possible to create sheets 26 and 28 from a single larger sheet, by creating a lengthwise fold in the larger sheet, thereby forming an edge 46 by virtue of the fold, and utilizing an edge fastener to bring the other two edges of the material together in edgewise attachment, as is shown in FIG. 5 at 47.

I have found that the difference in width between the curved sheet and the flat sheet may be varied over a reasonable range, although preferred results are achieved when the curved sheet is substantially about 15–40 percent greater in width than the flat sheet. The outward bow of the curved sheet tends to sag when the ratio of widths is increased, when the structural beam 20 is mounted in a horizontal configuration, due to the effects of gravity upon the flexible outwardly bowed curved sheet. In one embodiment which has achieved desirable results, a flat sheet 26 having a width dimension of about 14 inches was utilized with a curved sheet having a width dimension of about 18 inches, and an outward bow was achieved where the curved sheet was displaced from the flat sheet a distance of about 3–7 inches; this construction appeared to produce a relatively rigid shape for the structural beam 20, and the structural beam 20 retained this shape while being handled for mounting to a portable display frame. After attachment to the portable display frame the structural beam 20 retained a rigid horizontal appearance and gave the perception of a strong, overhead beam bridging between the ends of the portable display structure.

It is believed that the outwardly bowed curved sheet 28 creates an outward tension on sheet 26, thereby tending to retain sheet 26 in a flat position. I have found that the best results appear to occur when the flat sheet 26 is somewhat thinner than the bowed sheet 28, for example, when sheet 26 has a thickness of about 0.020 inches and sheet 28 has a thickness of about 0.040 inches.

In the preferred embodiment of my invention, sheets 26 and 28 may be constructed from polycarbonate plastic sheet material, having a thickness of about 0.010–0.050 inches. In one embodiment of my invention, it is expected that graphics will be incorporated by a printing process across the sheet 26, which provides an elongated surface for presenting the graphics. In another embodiment of my invention sheet 28 may be constructed from translucent plastic sheet material, to permit light radiating from the rear of structural beam 20 to pass through sheet 28 onto the rear surface of sheet 26. Sheet 26 may similarly be constructed of translucent material, and may have graphic information printed thereon in opaque printing, and when used in combination with a transparent or translucent sheet 28 and rear lighting, the appearance of beam structure 20 from the front is as though the beam structure itself incorporated interior lighting to illuminate the graphics placed on sheet 26. This feature is particularly advantageous in conjunction with display lighting which is typically used in this field, wherein such display lighting is typically hung along the top edge of framework 12 to project downwardly onto surface 32. When an overhead beam structure of the foregoing type is used in conjunction with such lighting, the lighting also passes through the transparent sheet 28 to illuminate sheet 26, and to give the visual perception of an interior-lighted beam structure 20.

In operation, the portable display panel 10 is erected in its normal and ordinary fashion, and the plastic panels are attached along the front inner curved surface in the manner selected by the manufacturer of portable display structure 10.

Beam structure 20 is typically assembled by laying sheet 26 along a floor surface, and aligning one edge of sheet 28 to an edge of sheet 26, thereby utilizing the edge magnetic strips to form an attachment bond between the two edges. Sheet 28 is then bowed outwardly to permit alignment of its other edge with the respective other edge of sheet 26, to form an adhesion along the magnetic strips of the other edge. Beam structure 20 may then be lifted as a semi-rigid structure and attached to the portable display structure framework according to any of the attachment mechanisms which may be selected for such attachment. The attachment mechanisms may be as simple as a single end point attachment at either end, or a combination of an end-point attachment and a corresponding magnetic-strip attachment at either end. After such attachment, beam structure 20 will remain affixed to portable display 10 and will appear as a rigid overhead beam to enhance the visual perception of strength and rigidity to the overall structure, and also to provide graphic presentation where desired.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A lightweight portable beam adapted for hanging attachment to a portable exhibit display frame, comprising a first thin plastic sheet of flexible material of a first predetermined width and an elongate length; a plate affixed to each of the elongate ends of said first sheet, said plate having means for removable attachment to said portable exhibit display frame; a second thin plastic sheet of flexible material of a second predetermined width, greater than said first width, and an elongate length; means for removably attaching said first sheet to said second sheet along respective edges of said elongate lengths, whereby said second sheet is affixed to and bowed outwardly from said first sheet; whereby said beam may be supported on said frame only by said end plate means for removable attachment, and said sheets may be detached from each other and respectively rolled together for storage.

2. The apparatus of claim 1, wherein said means for attachment along at least one pair of respective elongate edges further comprises magnetic strips affixed along said edges.

3. The apparatus of claim 2, wherein said second sheet is constructed of translucent material.

4. The apparatus of claim 1, wherein said second sheet is constructed of translucent material.

5. The apparatus of claim 3, wherein said second sheet is thicker than said first sheet.

6. The apparatus of claim 5, wherein said first and second sheets are constructed of polycarbonate material.

7. A lightweight portable beam adapted for attachment to portable display structures, comprising:

(a) a first thin plastic sheet of flexible material having an elongate length and a relatively smaller and predetermined first width, said first sheet having gripping material along respective elongate edges and having end plates affixed across the width of its respective ends, said end plates having means for attachment to said portable display structure; and (b) a second thin plastic sheet of flexible material having an elongate length and a relatively smaller and predetermined second width, said second width being greater than said first width, and said second sheet having gripping material along respective elongate edges adapted to releasably adhere to the gripping material along respective elongate edges of said first sheet, whereby said first and second sheets may be releasably adhered together along respective elongate edges with said second sheet bowed outwardly from said first sheet.

8. The apparatus of claim 7, wherein said second width is at least about 15 percent greater than said first width.

9. The apparatus of claim 7, wherein said second sheet is constructed of translucent material.

10. The apparatus of claim 7, wherein said end plates each further comprising a mechanical connector means for attachment to said portable display structure.

11. A lightweight portable beam formed of flexible sheet material, comprising (a) a first sheet of flexible material of generally rectangular shape, having means for adhesive attachment disposed along a first two respectively parallel edges; said edges being displaced apart by a first predetermined distance; said first sheet also having a second two parallel edges mutually perpendicular to said first two parallel edges;

(b) a second sheet of flexible material having at least two parallel edges spaced apart by a second predetermined distance, larger than said first predetermined distance, and having means for adhesive attachment disposed along said parallel edges; and (c) an attachment plate affixed respectively to each of said second two respectively parallel edges of said first sheet.

12. The apparatus of claim 11, wherein said first and second sheets further comprise sheets of flexible plastic material.

13. The apparatus of claim 12, wherein said second predetermined distance is from 15–40 percent greater than said first predetermined distance.

14. The apparatus of claim 13, wherein said attachment plate further comprises means for attachment to a portable display frame.

15. The apparatus of claim 14, wherein said second sheet further comprises a light-translucent material.

16. The apparatus of claim 15, wherein said first and second sheets are each about 0.020 inches in thickness.

* * * * *